United States Patent [19]

Wedel

[11] 4,369,586

[45] Jan. 25, 1983

[54] DRYER SIPHON

[75] Inventor: Gregory L. Wedel, Beloit, Wis.

[73] Assignee: Beloit Corporation, Beloit, Wis.

[21] Appl. No.: 255,844

[22] Filed: Apr. 20, 1981

[51] Int. Cl.[3] ..... F26B 13/08

[52] U.S. Cl. ..... 34/125; 34/119

[58] Field of Search ..... 165/86, 87, 88, 89; 34/119, 124, 125

[56] References Cited

U.S. PATENT DOCUMENTS

| | | | |
|---|---|---|---|
| 2,420,824 | 4/1944 | Hornbostel et al. | 34/125 |
| 2,521,371 | 5/1946 | Hornbostel et al. | 34/125 |
| 2,844,887 | 2/1957 | Hornbostel | 34/119 |
| 2,869,248 | 1/1959 | Justus | 34/54 |
| 2,892,264 | 6/1959 | Armstrong | 34/125 |
| 2,993,282 | 7/1961 | Daane et al. | 34/125 |
| 3,034,225 | 5/1962 | Hieronymus | 34/125 |
| 3,264,754 | 8/1966 | Kutchera | 34/124 |
| 3,449,839 | 6/1969 | Crist | 34/124 |
| 3,640,000 | 2/1972 | Lee et al. | 34/125 |
| 4,081,913 | 4/1978 | Salminen | 34/41 |

FOREIGN PATENT DOCUMENTS

| | | | |
|---|---|---|---|
| WO80/00329 | 10/1980 | PCT Int'l Appl. | 34/125 |
| 701321 | 1/1965 | United Kingdom | 34/125 |
| 273649 | 1/1969 | U.S.S.R. | 34/125 |

*Primary Examiner*—Larry I. Schwartz

*Attorney, Agent, or Firm*—Hill, Van Santen, Steadman, Chiara & Simpson

[57] ABSTRACT

A steam heated dryer drum for use in a papermaking machine with the drum including a cylindrical rotary hollow drum shell and a structure for removing condensate formed from the steam within the shell including a conduit leading from inside to outside the shell and an improved shoe structure connected to the conduit extending axially along the inner surface of the drum with a leading and a trailing angled face and end walls resting on spacers to lift the leading face and form a condensate receiving gap and a chamber within the elongate shoe for receiving condensate passing under the edge of the faces.

10 Claims, 4 Drawing Figures

DRYER SIPHON

BACKGROUND OF THE INVENTION

The invention relates to improvements in paper machine dryer drums, and more particularly to an improved condensate removal system with a shoe capable of improved removal of condensate forming on the inner surface of the drum.

In a papermaking machine after the web is dewatered and pressed, it is passed to the dryer section which conventionally embodies a plurality of cast iron steam heated rotating dryer cylinders. Steam enters each of these dryers and condenses as it transfers heat to the dryer shell, and the dryer shell in turn transfers heat to the paper causing the moisture in the paper to evaporate. It is essential to producing a satisfactory paper sheet that the dryer drum transfer heat efficiently and uniformly to the sheet, and it is essential to satisfactory and economical operation that effective and efficient heat transfer occur from the steam in the drum to the shell. A large factor in controlling and attaining effective heat transfer is the removal of the condensate within the drum. This condensate may be ponding, cascading or rimming, and the state of the condensate depends upon a number of factors, but the siphon assembly which is provided to remove the condensate must be capable of satisfactory removal whether the condensate is ponding, cascading or rimming.

When the condensate is rimming, the heat must be transferred through it, and this is a thermal problem. The thicker the condensate layer, the higher the thermal resistance. When the condensate is not rimming, the problem becomes a mechanical one, and if the condensate layer becomes too large, it takes longer to speed up, and the drive loads increase and the drive torque becomes erratic which has a deleterious effect on the quality of the paper being manufactured. Therefore, it is important to minimize the amount of condensate in the dryer drum at all times.

It is, therefore, an important object of the present invention to provide an improved dryer drum and siphon condensate removal system which minimizes the amount of condensate in the drum at all times and is capable of handling the condensate whether it be ponding, cascading or rimming.

In general in present commercial dryers, the steam enters the dryer drum often through a backside journal, and the condensate is evacuated through a frontside journal along with some uncondensed steam which is termed blow-through. The components of the siphon assembly are the siphon shoe which is usually positioned adjacent the inner surace of the shell, the radial pipe through which the condensate flows after it is picked up by the shoe, the siphon elbow which turns the flow of condensate to a horizontal direction, the horizontal pipe, and the rotary steam fit. These items make up the dryer siphon assembly and are each important, but a salient feature of the instant invention is the design of the shoe which is capable of effective removal of the condensate and thorough more complete removal for the conservation of energy and the production of a better paper web.

The achieving of a structure which can operate with a thinner layer of condensate will reduce the insulating effect of the condensate. It has been found that the condensate depth decreases consistently with decreasing clearance between a siphon shoe to a point of approximately 0.040". Once that point has been reached, the condensate cannot be reduced in thickness by any further reduction in siphon clearance, and this feature is taken into consideration in connection with the design of the siphon shoe of the instant invention.

As stated above, the condensate may take different forms in either cascading, puddling or rimming, and it is well known as recited in White, R. E. "Residual Condensate, Condensate Behavior, and Siphoning in Paper Driers", TAPPI, Vol. 39, No. 4, April 1956, p. 228–233, that at lower dryer speeds, condensate which is still in the dryer drum will form a puddle in the bottom of the dryer. At slightly higher speeds, this condensate starts to climb the wall of the dryer shell and then cascade back into the puddle. An excessive amount of condensate cascading off the dryer wall will produce a large and erratic drive load. At higher speeds, the condensate forms a thin circumferential layer on the inside dryer surface, and this layer acts as a thermal insulator. Under these rimming conditions, an excessive amount of condensate in the dryer will produce an excessive thermal resistance. To avoid both of these operating conditions, the amount of condensate in the dryer must be kept at a minimum, and in accordance with the features of the present invention, the design of the siphon shoe greatly influences the value of this minimum. During nonrimming conditions, the siphon shoe will evacuate condensate only when it is submerged in the condensate puddle, that is, when the siphon shoe is in the region where it projects downwardly so as to be in the puddle. During the rest of the cycle, the siphon shoe is exposed only to the steam which is under pressure in the drum and hence only blow-through steam is being evacuated, rather than condensate.

In order to evacuate as much condensate as possible during the time the siphon shoe is submerged, conventional siphon shoes have heretofore been designed for nonrimming conditions and have a large spacing between the siphon shoe and the dryer shell, or a large opening in the bottom of the siphon shoe. With this construction and the use of a large opening, the blow-through flow rate of steam is excessive when the siphon shoe is not submerged. Further, the amount of condensate in the dryer is very large during high speed rimming operation.

In accordance with the features of the present invention, the foregoing problems are minimized by the design of the siphon shoe such that a relatively small spacing, optimally 0.040" is provided between the siphon shoe and the inner surface of the dryer shell. It has been discussed that the spacing has an effect on the thickness of the layer of rimming condensate by Calkins, D. L., "The Effects of Siphon Clearance on Dryer Performance", The Johnson Corporation, Three Rivers, MI., 1966. The small spacing in conventional designs, however, has a disadvantage of providing a very poor nonrimming performance.

A further feature of the invention substantially improves the condensate removal performance in that the profile of the edge of the siphon shoe which first contacts the condensate puddle is uniquely constructed. This edge slopes in an angular face toward the inner surface of the shell and has a large projected opening which is tapered down to a small siphon shoe to dryer shell spacing. The angle of the ram face which faces in the direction of rotation of the dryer should be in the range of 10° to 45° and of a height which is preferably in the range of 0.2" to 1.0". This leading edge acts as a channel which forces the condensate into the small opening and has a ram effect greatly enhancing the nonrimming performance of the siphon which is mounted very close to the dryer shell.

A further object of the invention is to provide an improved siphon shoe which extends axially along the shell for an optimum length and which is of improved design construction for receiving and removing condensate forming on the inner surface of the shell.

A further feature of the invention is to provide a siphon shoe with a center enlarged chamber portion.

A further object of the invention is to provide an improved siphon shoe of a design which is structually efficient to manufacture and which is capable of the improved removal of condensate from a steam dryer drum.

Other objects, advantages and features will become more apparent with the teaching of the principles and concepts of the invention in connection with the description of the preferred embodiment in the specification, claims and drawings, in which:

DRAWINGS

DESCRIPTION OF THE PREFERRED EMBODIMENTS

Figure 1:
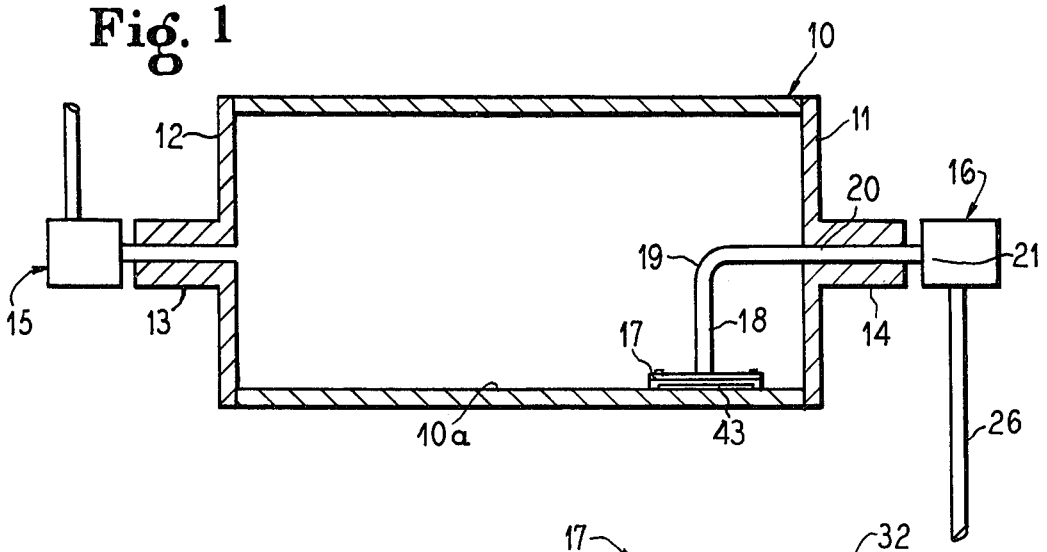
FIG. 1 is a somewhat schematic vertical sectional view taken through a dryer drum assembly.

As illustrated in FIG. 1, a hollow cylindrical rotary steam dryer drum assembly is shown with a hollow annular shell 10 having a smooth outer surface for contacting a paper web and a smooth inner cylindrical surface 10*a*. The shell is supported on heads 11 and 12 which have rotation supporting hubs 13 and 14 which are shown somewhat schematically but are provided with detailed bearings and drives as will be known to those versed in the art.

For heating the shell 10 to paper web drying temperature, steam is directed to the interior of the drum through a supply conduit 15.

At the other supporting hub 14, a condensate removal conduit means is provided which includes a siphon shoe 17 (which will be shown and described in greater detail in FIGS. 2 thru 4), a radial conduit 18, an elbow or bend 19, an axially extending pipe 20 and a rotary steam fit joint 21. The joint provides a suitable connection within a construction housing 16 leading to a condensate and steam blow-through line 26.

Figure 2:
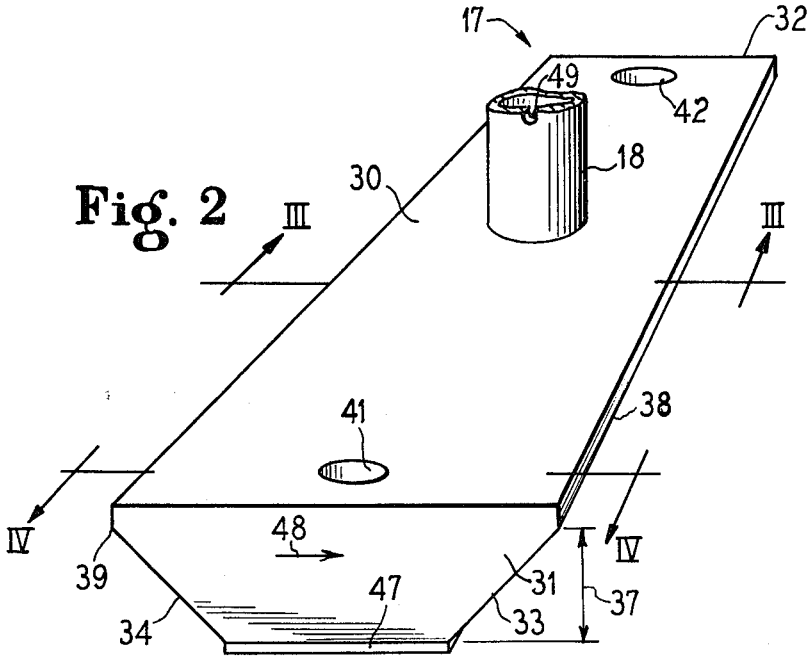
FIG. 2 is an enlarged perspective view of a dryer siphon shoe constructed and operating in accordance with the principles of the present invention.
Figure 3:
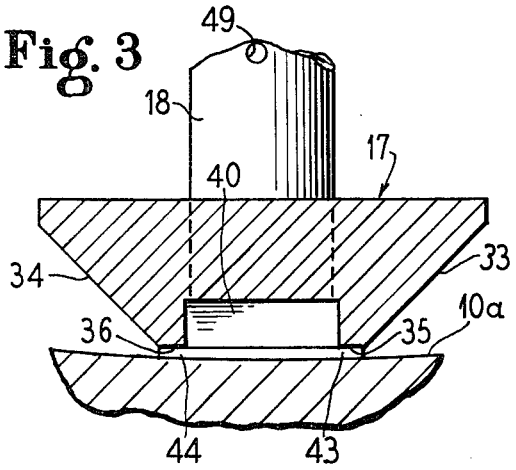
FIG. 3 is a vertical sectional view taken substantially along line III—III of FIG. 2.
Figure 4:
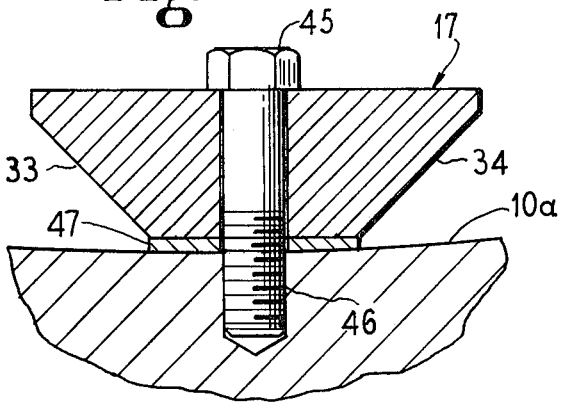
FIG. 4 is a vertical sectional view taken substantially along line IV—IV of FIG. 2.

The siphon shoe is shown in greater detail in FIGS. 2 through 4 and is constructed to be elongate and extend axially relative to the drum shell 10. The shoe has a back 30 which is essentially in the form of a flat plate. At the leading edge 38 and trailing edges of the shoe are leading and trailing ram faces 33 and 34. These faces are flat, and the leading ram face 33 co-acts with the inner surface 10*a* of the shell to form a channel of decreasing width for forcing the condensate into a gap or slot 43 at the lower edge 35 of the face 33. The trailing face 34 is of the same angle and size as the leading face 33 so that the shoe 17 is symmetrical about an axially extending centerline. This permits installation in the drum in either direction and does not adversely affect the operation of the shoe.

A gap 44 on the trailing edge maintains a space between the shoe and the shell so that condensate can enter from both directions into a central chamber 40 extending the length of the shoe. The shoe has end plates 31 and 32 which close the ends of the chamber 40. Preferably, the shoe is made as a casting to the shape illustrated, but it may be fabricated or formed of materials other than metal.

To define the gaps 43 and 44 beneath the edges of the faces 34 and 33, the shoe is spaced from the inner surface 10*a* of the shell by spacer blocks 47 at each end of the shoe. These spacer blocks are of a thickness to define the gap 43 at the leading edge and the gap 44 at the trailing edge. The gap preferably is of a dimension 0.04", and it has been found that this is an optimum size. Preferably, the gap is less than 0.08", and it has been found that increasing the gap beyond that dimension decreases effectiveness and decreasing the gap to less than 0.04" does not increase effectiveness for removal of condensate.

The shoe is held in place by suitable means, preferably by bolts 45, FIG. 4 which extend through holes 41 and 42 in the back 30 of the shoe. These holes are threaded into threaded receiving holes 46 in the inner surface 10*a* of the shell.

The radial conduit 18 is provided with a steam bleed hole 49 on the order of ¼" in size, and this steam bleed hole is positioned 2" to 3" radially inwardly from the inner surface 10*a* of the shell.

It has heretofore not been appreciated that a small clearance between the siphon and shell is advantageous in a collector or a shoe which has a large perimeter, i.e., a substantial length of collection area. The provision of a large perimeter with a small clearance eliminates the need for grooves and effectively removes condensate permitting a dryer drum shell with a smooth interior that avoids the disadvantages of a grooved drum.

A further feature of the structure is the provision of a shoe with a larger perimeter wherein the shoe is open on the front and rear sides. That is, the two edges which are in close clearance with the interior of the shell are parallel to each other and are equally spaced from the inner surface of the shell. Further, the gaps are located both on the leading and trailing edge of the chamber so as to aid in the intake of condensate. Condensate is normally taken in both from the leading elongate edge and the trailing edge of the chamber simultaneously, although the leading edge is aided in the ram effect. The feature of the gap on both sides in an elongate shoe also aids in increased speed of condensate evacuation when the condensate puddles or cascades within the dryer drum shell. Also, the shoe can be installed in either direction because of its symmetry thereby avoiding any malfunction of the dryer drum due to improper assembly of the shoe within the interior. The elongate axial shoe has a uniform gathering effect as to rimming condensate that is forced into the lead edge, and condensate does not tend to flow around or bypass the shoe, but is acted on uniformly along the entire length of the shoe. The large perimeter combined with the small gap clearance attains advantages not possible and not recognized by structures heretofore available.

The long axis parallel to the dryer axis makes it possible to provide a shoe which does not have to be machined to match the curvature of the dryer shell. The spacing is easily set and maintained by the spacing pads at the ends of the shoe. No special machining or fabricating techniques are required.

The present shoe achieves a substantially thinner non-rimming condensate puddle depth when puddling occurs. Generally, higher differentials between the inside of the drum and the steam escape passage will produce shallower puddle depths but at the expense of increasing blow-through steam. It is desirable to minimize steam blow-through, and the present shoe construction can achieve a minimum residual condensate volume with a minimum amount of blow-through. Prior siphons have often embodied circular or small intakes or in the event the intake is straight, have provided for only one side for evacuating rimming condensate. These prior siphons will then require twice the length of present design to obtain the same open perimeter.

In operation, the dryer drum rotates in a direction so that the shoe moves in the direction indicated by the arrowed line 48. Condensate is captured beneath the leading ram face 33 and is forced beneath the lower edge of the face to pass into the chamber 40. The siphon system with the radial line 18 draws the condensate up and out of the drum. With the small clearance 43 beneath the leading edge, as well as the clearance 44 beneath the trailing edge, condensate is drawn from both directions up into the chamber 40 to be removed. The axial length of the shoe is no greater than 22" inasmuch as it has been discovered that at that length, any increase in size will not increase the effectiveness of the shoe.

The structure is relatively uncomplex, operates to effectively remove condensate whether the condensate is rimming, puddling or cascading within the drum. The structure is such that it does not induce stresses into the drum nor adversely affect the heat transfer from the steam within the drum to the outer surface of the drum. This structure attains the objectives and advantages above set forth and provides an improved paper product by improving heat transfer and improves thermal transfer so that the cost of paper production is reduced.

I claim as my invention:

1. A paper machine dryer mechanism comprising in combination:

a rotary annular hollow cylindrical dryer drum shell having a smooth inner surface and having means for delivering steam to the interior for heating the outer surface of the drum to dry a paper web in contact with the outer surface;

a condensate siphon conduit means leading from the interior of the drum to the exterior for removing condensate forming on the inner surface of the shell;

and a siphon shoe connected to the inlet end of the conduit means for receiving condensate from the inner surface of the shell, said shoe having an elongate planar leading face extending axially and tapered toward the inner surface of the shell with said tapered face defining a condensate receiving gap between said edge and said shell inner surface with said gap being of uniform radial depth in an axial direction across the shell, said shoe having an elongate planar trailing face tapered toward the inner surface of the shell and having a trailing condensate delivery gap with said trailing gap being of uniform radial depth in an axial direction across the shell, said shoe having an inner axially elongate chamber between said planar faces for receiving the flow of condensate with the chamber communicating with the siphon conduit means and with each of said leading and trailing gaps.

2. A paper machine dryer mechanism constructed in accordance with claim 1:

including spacers at the axial ends of the shoe supporting the shoe on said shell inner surface and defining the depth of said condensate gaps.

3. A paper machine dryer mechanism constructed in accordance with claim 1:

including spaced bolts extending radially through said shoe and threaded into the shell for supporting said shoe in position on the shell.

4. A paper machine dryer mechanism constructed in accordance with claim 1:

including an elongate trailing face on said shoe of the same construction as said leading face with an elongate lower edge defining a gap between the edge and the shell surface at the lower extremity of the trailing face.

5. A paper machine dryer mechanism constructed in accordance with claim 1:

wherein said leading face forms an angle of substantially 45° with the inner surface of the shell.

6. A paper machine dryer mechanism constructed in accordance with claim 1:

wherein the length of said axially elongate chamber is no greater than 22".

7. A paper machine dryer mechanism constructed in accordance with claim 2:

wherein said spacers define said condensate receiving gap of a radial height of substantially 0.04".

8. A paper machine dryer mechanism constructed in accordance with claim 1:

including a steam bleed opening means in the conduit means a small distance above said shoe.

9. A paper machine dryer mechanism constructed in accordance with claim 1:

wherein the leading upper edge of said shoe face is substantially 1" from the inner surface of the shell.

10. A paper machine dryer mechanism comprising in combination:

a rotary annular hollow cylindrical dryer drum shell having a smooth inner surface and having means for deliverying steam to the interior for heating the outer surface of the drum to dry a paper web in contact with the outer surface;

a condensate siphon conduit means leading from the interior of the drum to the exterior for removing condensate forming on the inner surface of the shell;

a siphon shoe connected to the inlet end of said conduit means for receiving condensate from the inner surface of the shell, said shoe extending axially along the inner surface of the shell and having an axial back portion substantially parallel to the shell with said back portion supporting a planar leading face and a planar trailing face each of said faces tapered inwardly toward each other and toward the shell to form tapered gaps of uniform depth in an axial direction along the shell, said shoe having ends with an axially elongate chamber between the ends and between said faces and said chamber communicating with the siphon conduit means, spacer blocks positioned between the ends of the shoe and the shell so that the edge of the faces closest to the shell surface is raised off of the inner surface of the shell to provide said condensate receiving gaps between the shell and planar faces.

* * * * *